United States Patent [19]

Harris

[11] 4,327,975

[45] May 4, 1982

[54] LIGHT-BEAM-PROJECTING APPARATUS

[76] Inventor: Lee M. Harris, 4975 North Way, Eugene, Oreg. 97402

[21] Appl. No.: 141,133

[22] Filed: Apr. 16, 1980

[51] Int. Cl.[3] ..... A63J 17/00

[52] U.S. Cl. ..... 353/50; 353/1; 353/98; 84/464 R

[58] Field of Search ..... 84/464 R, 464 A; 353/1, 353/15, 98, 99, 50

[56] References Cited

U.S. PATENT DOCUMENTS

| | | | |
|---|---|---|---|
| 3,318,187 | 5/1967 | Prohaska | 353/15 |
| 3,572,919 | 3/1971 | Hayes | 353/15 |
| 3,590,681 | 7/1971 | Cross | 84/464 |
| 4,010,361 | 3/1977 | Latterman et al. | 84/464 |
| 4,205,585 | 6/1980 | Hornick | 84/464 |
| 4,227,785 | 10/1980 | Herbert | 353/98 |

*Primary Examiner*—John W. Shepperd
*Attorney, Agent, or Firm*—Kolisch, Hartwell & Dickinson

[57] ABSTRACT

A light-beam projecting apparatus usable in connection with sound-producing equipment for creating, on a remote surface, infinitely varying light-impingement patterns which are directly related to the instantaneous sound. The device includes a light beam source, a reflector, a sound-signal-actuated movable driver and a plurality of interconnectors connecting the driver and the reflector. Each interconnector, having a different resonant frequency, reacts to a sound signal by producing vibrations which are different from the vibrations of the other interconnectors, causing the reflector to oscillate in a manner sympathetic to the instantaneous sound signal.

2 Claims, 3 Drawing Figures

FIG. 1
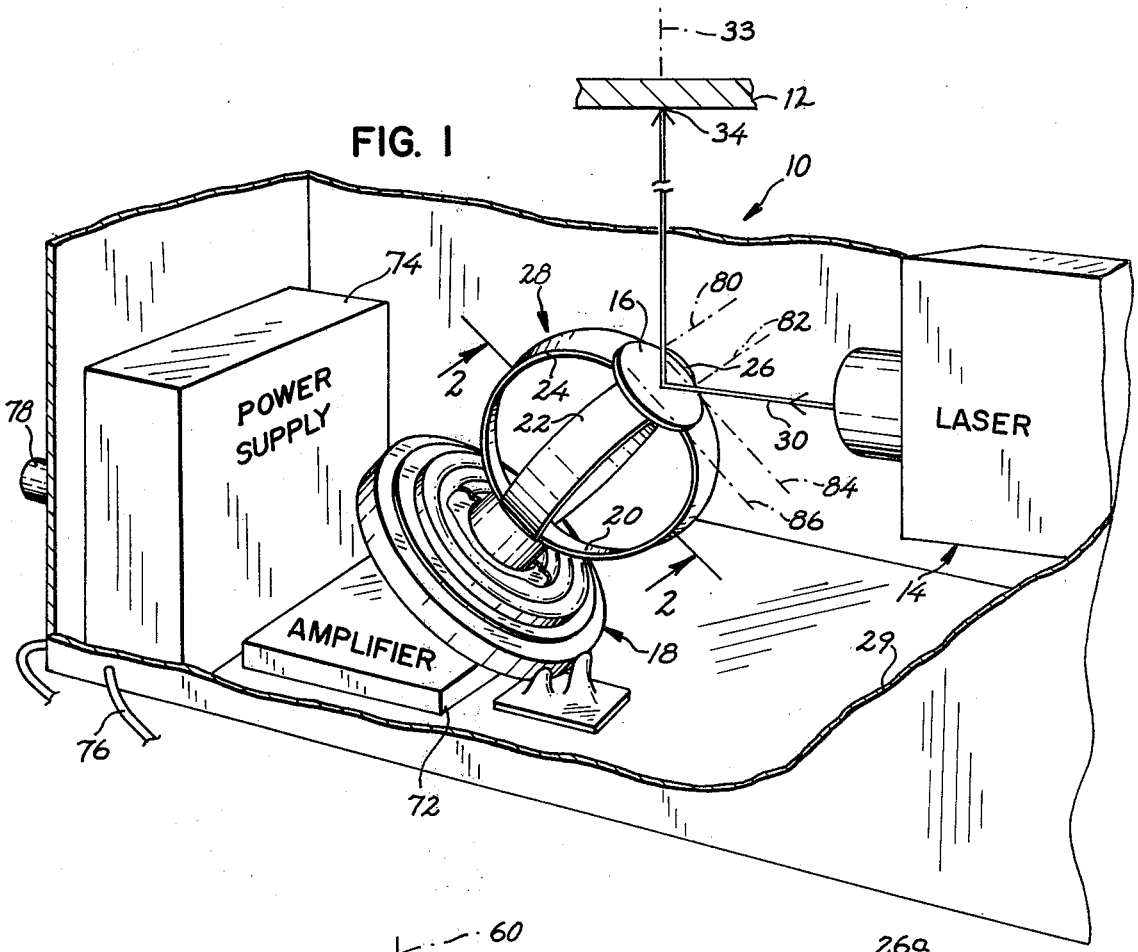
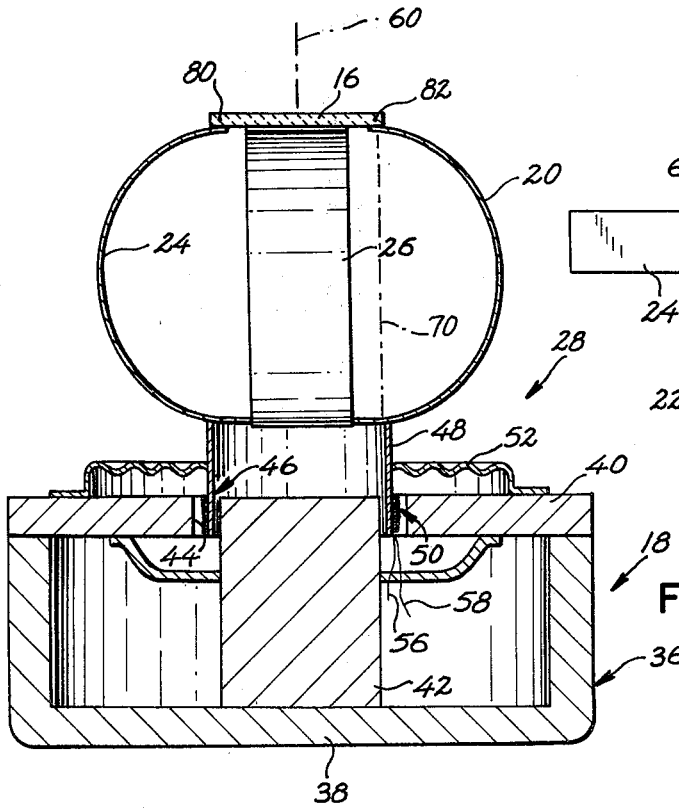
FIG. 2
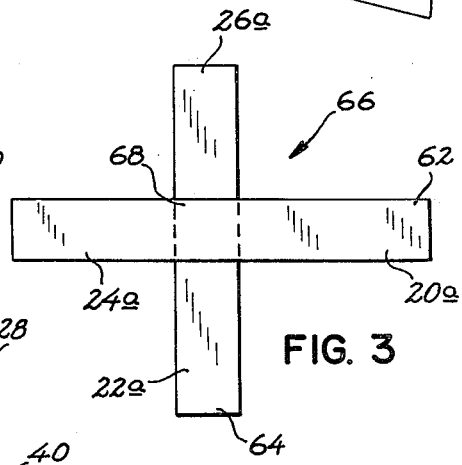
FIG. 3

LIGHT-BEAM-PROJECTING APPARATUS

BACKGROUND AND SUMMARY OF THE INVENTION

This invention relates to apparatus for creating from a sound source, infinitely varying light-impingement patterns on a remote surface, such patterns having a direct relation with the instantaneous sound.

It is popular to accompany various musical performances, such as rock concerts, with light shows. One of the means used to produce a light show is to project a light beam, such as a lower power laser beam, in a dancing pattern onto a wall, ceiling, curved screen, or the like. It is desirable to produce a beam capable of projecting an infinite variety of movements and patterns directly related to the music being played at the time.

A general object of this invention is to provide a novel means for projecting such a beam in a manner directly relating the movement of the beam with the instantaneous sound.

More particularly, an object of the present invention is to provide a reflector connected to spring-like legs, with the legs suitably mounted on a conventional sound-signal-actuated movable element, such as the voice coil in a loudspeaker. Such element, when actuated, causes movement to be transmitted to the reflector by way of the legs.

A further object of the present invention is to provide a plurality of legs interconnecting the movable element and the reflector, with each leg comprising an elongated spring-like member of one length, differing in lengths from the other members, thus characterizing different resonant frequencies. When the movable element is actuated by a variable-frequency sound signal, the movement transmitted from the movable element to the reflector by way of the interconnecting legs causes variable rocking motion in the reflector.

Still another object of the invention is to reflect a projected light source, such as a low power laser beam, from the activated reflector to a remote surface in a manner directly related to the nature and character of the inputted musical signals, thus creating an infinite variety of light impingement patterns on that surface.

These and other objects and advantages which are attained by the invention will become more fully apparent as the description which now follows is read in conjunction with the accompanying drawings, wherein:

FIG. 1 is a perspective view of apparatus constructed according to the present invention, with cabinet parts cut away;

FIG. 2 is an enlarged, sectional view taken generally along line 2—2 in FIG. 1; and FIG. 3 is a plan view of a form used in constructing the interconnectors employed in the invention.

DETAILED DESCRIPTION OF A PREFERRED EMBODIMENT OF THE INVENTION

Looking first at FIG. 1, at 10 is shown a light-beam projecting apparatus constructed according to the present invention. Apparatus 10 is usable with a signal-producing device, such as a sound-reproduction device (not shown), for creating light-impingement patterns on a remote surface, such as screen 12, in a manner directly related to the instantaneous signal received by the apparatus. Very generally, apparatus 10 includes a light-beam producer 14, a reflector 16, a signal-actuated driver 18, and a plurality of legs, or interconnectors 20, 22, 24 and 26 connecting the driver to the reflector. Driver 18, reflector 16 and the just-mentioned interconnectors form a signal-response unit 28 which functions to transduce incoming sound signals into oscillatory reflector movement, which movement varies according to the incoming signal frequencies, as will be described. Producer 14, unit 28, and electronic components used to amplify incoming electrical signals are housed in a cabinet 29, shown fragmentarily in FIG. 1.

Looking now at details of apparatus 10, first with reference to FIG. 1, a producer 14 is a low-power laser whose power output is about one milliwatt or less. Producer 14 produces a light beam 30 which impinges on the central region of reflector 16, as shown. With mirror 16 in a stationary condition, a beam 32 produced by the reflection of beam 30 is projected along a substantially upright axis, indicated by dashed-dot line 33 in FIG. 1. Beam 32 projects through a suitable opening (not shown) in the top of the cabinet. The area of impingement of beam 32 on screen 12 is indicated at 34. Producer 14 and reflector 16 are also referred to herebelow as light-beam source means.

Looking now at FIG. 2, driver 18 generally includes the electrodynamic components of a permanent-magnet loudspeaker, with the sound-producing cone removed. More particularly, driver 18 includes a cylindrical frame 36 having base and cap plates 38, 40, respectively. A cylindrical permanent magnet 42 extends through an opening 44 formed in plate 40. The driver's voice coil 46 is composed of a sleeve-like element, or core 48 having plural electrically conductive windings 50 wound around the core's lower end portion. The coil is mounted on frame 36 by a support spider 52, flexibly joining coil 46 to plate 40, as shown. Thus mounted, the wound portion of coil 46 is interposed between, and spaced from, magnet 42 and the sides of opening 44. Signal input to driver 18 is through winding connections 56, 58. Signal input to coil 46 produces oscillation thereof, at the input signal frequency, along the coil's axis, indicated by dashed-dot line 60. Windings 50 and magnet 42 which cooperate to produce such oscillation, by magnetic coupling, are also referred to herebelow as means for producing oscillation of core 48.

As seen in FIGS. 1 and 2, interconnectors 20, 22, 24 and 26 are elongated spring-like legs which are coiled to extend between the upper end of coil 46 in FIG. 2 and the lower surface of reflector 16. According to an important feature of the present invention, at least two of the interconnectors have different lengths, and hence different resonant frequencies. In a preferred embodiment, each of the four legs of unit 28 has a length and resonant frequency which is different from those of the other three interconnectors. Preferably, the interconnectors are formed from a pair of acetate film strips 62, 64 which are connected as by gluing to produce the generally T-shaped form 66 shown in FIG. 3. Included in form 66 are a square base portion 68—where the two strips overlap and are adhered together—and four leg projections 20*a*, 22*a*, 24*a* and 26*a* extending therefrom. In one preferred embodiment, strips 62, 64 are bands of acetate film, each band having a thickness and width of about 0.25 millimeters and one centimeter, respectively. The lengths of the strips are between about 4 and 6 centimeters, with strip 64 being longer than strip 62. The strips are so joined that projections 20*a*, 24*a* are each a different length and each longer than projection 22*a*, 26*a*, which are also each a different length. Projections 20*a*, 22*a*, 24*a* and 26*a* are fashioned to form coiled interconnectors 20, 22, 24, 26, respectively, terminating, at their upper ends in FIG. 2, in a common plane. Portion 68 of form 66 is secured by cement adhesion to the upper end of coil 46, and reflector 16 is similarly attached, at its lower surface in FIG. 2, to the upper end portions of the four interconnectors. With particular reference to FIG. 2, it is noted that, in sectional view, the points of attachment of each interconnector, such as interconnector 20, to coil 46 and reflector 16 fall along a line, such as dashed-dot line 70 in FIG. 2, which is substantially parallel to axis 60.

Also mounted in cabinet 29, as noted above, are an amplifier 72 and an associated power supply 74 (FIG. 1). Amplifier 72 functions to amplify input signals delivered to drive 18 through connections 56, 58. The power supply and amplifier are of conventional design. Also shown in FIG. 1 are a power cord 76 which is suitably connected through an on-off switch (not shown) to power supply 74 and laser 14, and an input jack 78 through which the signal input source is connectable to the apparatus.

Considering now the operation of apparatus 10, and first that of assembly 28, each interconnector, such as interconnector 20, vibrates along a line, such as line 70, extending between the two ends of the associated interconnector, with such vibration occurring most strongly at characteristic resonant modes which are related to the length and elastic properties of the associated interconnector. Such modes are excited by oscillation of coil 46, produced in the manner described above, at frequencies corresponding to these modes. The dimensions and elastic properties of the interconnectors detailed above are such that interconnectors 20, 24 resonate in the 20–80 Hertz range, and interconnectors 22, 26, in the 40–100 Hertz range. For each interconnector the amplitude of vibration becomes stronger at lower frequencies.

With continued reference to FIG. 2, it can be appreciated that vibration of interconnector 20, along line 70, produces oscillatory movement of reflector 16 about an axis 80 which is substantially normal to the plane of the figure. Similarly, vibration of interconnector 24, at its resonant modes, produces oscillation of the reflector about a second axis 82 which is also normal to the plane of the figure. These two axes are shown in dashed lines in FIG. 1. Also seen in FIG. 1, in dashed lines, are the two axes 84, 86 about which reflector 16 oscillates in response to vibration occurring in interconnectors 22, 26, respectively. Thus, during operation, coil 46, vibrating at signal frequency, will cause one or more of the interconnectors to vibrate at or near one of its characteristic modes, producing oscillatory rocking of reflector 16 about one or more of the corresponding axes of oscillation just-mentioned.

A suitable variable-frequency signal, such as the sound signal from a sound-reproduction device is inputted apparatus 10 at jack 78. The signal is amplified by amplifier 72 and inputted driver 18, to produce variable-frequency and variable-amplitude oscillations in coil 46, according to the input signal frequency and amplitude, respectively. Oscillation of the coil, in turn, produces characteristic-mode vibrations of one or more of the interconnectors, as just described. As a result, reflector 16 oscillates, in rocking fashion, about one or more of the four above-mentioned axes, with such oscillation constantly changing according to changes in amplitude and frequency of the input signal. The projection axis of beam 32 undergoes similar oscillations, producing on screen 12 a light-impingement pattern which appears to "dance" on the screen 12, according to the oscillations produced in reflector 16. As noted above, the four interconnectors have greater oscillation amplitudes at lower frequencies, thus producing greater beam movement in the lower (20–40 Hertz) sound range. As a result, the viewer sees a light pattern which is coordinated with specific sound frequencies (due to differential movement of the different interconnectors), sound intensity (due to variable amplitude of interconnector oscillations), and sound range (due to greater interconnector oscillations at lower frequencies).

From the above, it can be appreciated how various objects of the present invention are met. In its intended use as a light display device in accompaniment with a musical performance, the apparatus produces a "dancing" light image which is highly coordinated with the instantaneous musical sound. The interconnector means described herein for connecting a signal-responsive driver to a reflector provides fast-time signal transduction to the reflector, over a wide range of driver frequencies. Such means is also simple in construction.

While a preferred embodiment of the present invention has been described, it is apparent the various changes and modifications in the apparatus may be made without departing from the spirit of the invention.

It is claimed and desired to secure by Letters Patent:

1. Electro-mechanical apparatus for changeably directing the projection axis of a reflected light beam to create thereby, on a remote surface, infinitely varying light-impingement patterns which are related to a variable-frequency electrical signal, said apparatus comprising a light-beam producer, a reflector positioned to reflect a beam produced by said producer, an oscillatable element, means for producing oscillation of said element at frequencies related to those of said signal, a first leg having one resonant frequency, interconnecting said element and said reflector, for producing in the latter, in response to movements occurring in the former, oscillatory rocking motion which occurs about a first axis, a second leg having a resonant frequency, different from that of said first leg, also interconnecting said element and said reflector, for producing in the latter, in response to movements occurring in the former, oscillatory rocking motion which occurs about a second axis angularly offset from said first axis, and a third leg angularly offset from said first and second legs, interconnecting said element and said reflector for supporting the latter in cooperation with said first and second legs.

2. Electro-mechanical apparatus for changeably directing the projection axis of a reflected light beam to create thereby, on a remote surface, infinitely varying light-impingement patterns which are related to a variable-frequency electrical signal, said apparatus comprising a light-beam producer, a reflector positioned to reflect a beam produced by said producer, an oscillatable element, means for producing oscillation of said element at frequencies related to those of said signal, a first pair of opposed, outwardly curved legs, each leg having a length operatively interconnecting said element and said reflector, for producing in the latter, in response to movements occurring in the former, oscillatory rocking motion which occurs about a pair of spaced, substantially parallel axes, and a second pair of opposed, outwardly curved legs, each having a length which is different from said lengths of said first pair of legs, also operatively interconnecting said element and said reflector, for producing in the latter, in response to movements occurring in the former, oscillatory rocking motion which occurs about a pair of spared, substantially parallel axis which are angularly offset from the first-mentioned pair of axes.

* * * * *